US011058928B2

(12) United States Patent
Lapuz

(10) Patent No.: US 11,058,928 B2
(45) Date of Patent: Jul. 13, 2021

(54) LIE ADAPTOR

(71) Applicant: Phillip Lapuz, Carlsbad, CA (US)

(72) Inventor: Phillip Lapuz, Carlsbad, CA (US)

( * ) Notice: Subject to any disclaimer, the term of this patent is extended or adjusted under 35 U.S.C. 154(b) by 0 days.

(21) Appl. No.: 16/857,734

(22) Filed: Apr. 24, 2020

(65) Prior Publication Data

US 2020/0282268 A1 Sep. 10, 2020

Related U.S. Application Data

(63) Continuation-in-part of application No. 16/213,883, filed on Dec. 7, 2018, now abandoned.

(51) Int. Cl.
*A63B 53/02* (2015.01)
*A63B 53/00* (2015.01)

(52) U.S. Cl.
CPC ..... *A63B 53/02* (2013.01); *A63B 53/007* (2013.01); *A63B 53/025* (2020.08)

(58) Field of Classification Search
CPC ..... A63B 53/02; A63B 53/065; A63B 53/007; A63B 2053/025; A63B 53/0487
See application file for complete search history.

(56) References Cited

U.S. PATENT DOCUMENTS

| | | | | |
|---|---|---|---|---|
| 7,931,542 | B2 | 4/2011 | Kusumoto | |
| 8,591,352 | B2 | 11/2013 | Hirano | |
| 2004/0229712 | A1* | 11/2004 | Jackson | A63B 53/007 473/340 |
| 2011/0123265 | A1* | 5/2011 | Moore | A63B 53/047 403/361 |
| 2012/0165115 | A1 | 6/2012 | Matsunaga | |
| 2018/0028877 | A1* | 2/2018 | Bennett | A63B 53/02 |

* cited by examiner

*Primary Examiner* — Jeffrey S Vanderveen
(74) *Attorney, Agent, or Firm* — Eric Hanscom

(57) ABSTRACT

This invention is directed toward a lie adaptor that can be used to adjust an angel at which the shaft attaches to the putter. In one embodiment, the lie adaptor is inserted into the hosel of a putter, and then secured to both the shaft and putter head. In another embodiment, the lie adaptor has a cavity in its upper portion into which the shaft fits. In either case, the lie adaptor can be made with a variety of angle adjustments possible, such that a golf shop or even an individual golfer can quickly, accurately, and economically adjust the putter lie.

5 Claims, 15 Drawing Sheets

LIE ADAPTOR

CROSS REFERENCE TO RELATED APPLICATIONS

This application claims priority back to U.S. Utility patent application Ser. No. 16/213,883, filed Dec. 7, 2018, the contents of which are incorporated by reference.

STATEMENT REGARDING FEDERALLY SPONSORED RESEARCH OR DEVELOPMENT

This invention was not federally sponsored.

FIELD OF THE INVENTION

This invention relates in the field of putters and more specifically, to a lie adaptor that allows a putter manufacturer, club fitter, retailer, or consumer to adjust the length, lie, and shaft of his/her putter quickly, accurately and in economical manner.

BACKGROUND OF THE INVENTION

The lie of a putter is extremely important, as an ideal putt will be accomplished with the toe and the heel of the putter level to the ground. If the toe is "up" in the air, the ball will be "pulled" off its intended target; when the toe is "down", the ball will be "pushed". In either case, even if the golfer perfectly lines up his/her putt, the ball will be unintentionally deflected away from the cup just because the lie was incorrect.

The length of a putter works with the lie angle to position the golfer's grip on the putter. Grip position changes depending on each golfer's unique body type and putting style. Two golfers of the same height might not have the same length of the arms thus each golfer would need a different length and lie angle on their respective putters to fit their body types. A putter with a length and lie angle that is not fit to the size of the golfer is detrimental to the golfer's ability to use the club. The golf industry has seen an increase in golf shops specializing in custom-fitted golf clubs.

The putter fitting process is a blend of objective and subjective feedbacks. The objective side is analyzing the data taken from various trials and observing the errors by use of the golf putter. Putter performance is measured utilizing high-speed cameras, accelerometer attachments, and laser alignment systems among other technologies. The subjective side is heavily weighted on the customers feeling toward the putter. Thus it is important to quickly and accurately be able to interchange various putter components to fit the putter to both types of feedback.

The advent of technology around measuring biomechanical movements has increased awareness around the importance of fitting equipment to optimize performance. The current putter fitting marketplace does not have a method to quickly change out the lie angle, shaft, or length of a putter without drastic changes to the putter head shape. The current tools used for putter fitting are not designed to be used on the golf course as they are not conforming to the United States Golf Associations rules and regulations.

Various efforts have been made for many years to resolve this problem, but none provides an efficient and economical solution.

There are some prior art examples. For examples, U.S. Pat. No. 7,931,542 to Kusumoto provides an adjustor element that can be screwed in between the shaft and the head of a wood. This invention, however, requires multiple threaded sections, support surfaces, and multiple adjuster elements.

US Patent Application Publication No. 2012/0165115 to Matsunaga, and U.S. Pat. No. 8,591,352 to Hirano, both of these applications describe golf club heads that have cavities into which a variety of gravity point adjusters can be inserted to change the center of gravity of the club.

US Pub No. 2018/0028877, to Bennett provides an adaptor to receive the shaft, a plurality of sleeves that angle the shaft and bolt at the bottom that holds the assembly together. This requires multiple elements to be manufactured and assembled together requiring more time between changing out the lie angles and the shafts. The bottom bolt has to be completely removed to change out the shaft type. Furthermore, the adaptor must be inline and on the same plane as the shaft limiting the possible angles to the size of the bottom opening hole that receives the bolt. The receiving hole inside the putter head would need to be conical at a minimum. This conical-shaped hole would limit the design possibilities in weighing the head. Just as an example the industry-standard shaft if 0.370 inches in diameter. The adaptor sleeve would have to be greater than the shaft and the hole would be even greater than the adaptor sleeve. If we use a 4 degree angle change over a 1 inch length this would result in an opening that would need to be a minimum of 0.509 inch. This is over a 37.5% increase in the area being lost due to the hole opening. This calculation would be the absolute minimum the opening would have to be and this is not including the thickness of the adaptor itself. An elbow-shaped adaptor would allow the receiving hole to remain cylindrical to match the standard shaft diameter allowing the putter head itself to be relatively unchanged maintaining the proper weight distribution in the putter head to optimize the moment of inertia which translates into a larger sweet spot or more forgiving golf club.

US Pub No. 2011/0123265, to Moore provides an adaptor made up of a plurality of cylindrical sleeves with the angle cut into the cylinder. Similar to the Bennett patent, the adaptor angle must be in a continuous line into the putter head creating a hole that takes on an elliptical shape whichever increases the amount of space taken in the head. Using a similar example a shaft of 0.370 inch in diameter over a 1 inch length is limited to a 6 degree angle in a 0.500 inch diameter envelope. An elbow-shaped lie adaptor is not limited by a section of the putter head because the angle is being changed outside of the head on a separate plane.

US Pub No. 2004/0229712, to Jackson provides a shaft connected to a spherical shape that is embedded into the putter head and held at the desired angle by a set screw. This assembly does not allow the user to quickly change out the shaft length. The mechanism used to hold in the spherical shape is a plate held down by a plurality of bolts. The set screw is used to hold the angle. Thus by unscrewing the set screw, the assembly does not come apart rather the spherical shape is allowed to rotate freely causing the shaft to also rotate freely rendering the putter unusable. There is a high degree of inaccuracy to changing from one desired angle to another. Furthermore, it would be inefficient to try to switch out the shaft and to alter the length.

Neither of these inventions allows a quick and effective way to change the lie of the club. Thus, there has existed a long-felt need for an efficient and economical means by which the lie of a putter can be adjusted. The current invention provides a solution to this problem by providing a one-piece, small, lightweight adjuster that can be easily attached to the shaft and head of a putter to provide a variety of lie angles.

The lie adaptor that is described in this application offers a way that the lie of a putter can be adjusted such that the toe and heel of the putter will remain at the proper angle during putting. The basic concept is to create a solid piece of metal with two main parts that are slightly offset to one another, with a connecting piece by which the lie adaptor can be attached to the putter. By having a plurality of preset lie angles attached to a shaft (rotating the device), the putter head can be angled to correct an incorrect lie.

SUMMARY OF THE INVENTION

It is, therefore, an object of the present invention to provide a lie adaptor that can be easily attached to the shaft and head of a putter to adjust the lie of the putter.

An additional object of the invention includes providing a lie adaptor that fits into the hollow shaft of a putter, and is also attachable to the putter head by a screw.

A further object of the invention is to provide a lie adaptor that has a cavity in its upper portion, into which a putter shaft, including a solid putter shaft, can be inserted.

Further objects of this invention include providing a single unit for effectively modifying the lie of a putter.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION

Figure 1:
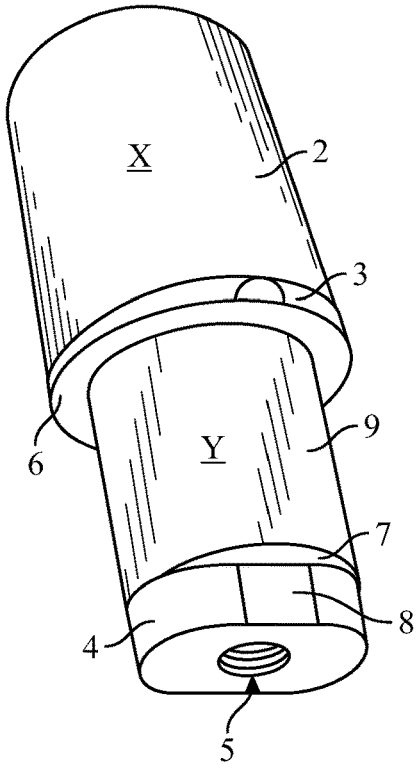
FIG. 1 is a front, perspective view of one embodiment of a lie adaptor that can be inserted into a hollow or solid shaft of a putter.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

In one embodiment of the present invention, as illustrated in FIG. 1 is a front, perspective view of a lie adaptor 1, the lie adaptor 1 that can be inserted into a hollow or solid shaft of a putter. The lie adaptor 1 has an adaptor hosel 2 that receives a putter shaft, a canted joint 3 that creates the adjustment in lie angle and a canted shaft 9. The adaptor hosel 2 fits into the end of a hollow putter shaft and can be secured with epoxy or another similar compound.

The canted joint 3 is manufactured to be "offset" from the adaptor hosel 2 by one or more degrees The canted joint 3 is configured to form an offset angle of connection between the putter shaft and the putter, The canted joint 3 includes a first shelf 6 that limits the depth of the lie adaptor.

The canted shaft 9 includes a male alignment guide 4, a threaded hole 5, a second shelf 7 and a connection face flat portion 8. The canted joint 3 connects the canted shaft 9 to the adaptor hosel 2. In one embodiment, the adaptor hosel 2 and the canted shaft 9 are on separate planes, namely, as illustrated in FIG. 1, the adaptor hosel 2 is on a plane X, and the canted shaft 9 is on plane Y.

The canted shaft 3 is inserted into a cavity in an upper portion of a putter head of a putter. In the preferred embodiment, the diameter of the canted shaft 3 is 0.355 inch or 0.370 inch, these are the industry standard shaft diameters. In one embodiment, the diameter of the canted shaft 9 is smaller than the inner diameter of the adaptor hosel 2, where the canted shaft 9 is configured to slide into the adaptor hosel 2.

It is contemplated that a variety of these lie adaptors could be made with a variety of offset angles, such that a shop adjusting the putter for a client could try out several different lie adaptors before selecting the one appropriate for that client and securing it into the putter shaft.

The male alignment guide 4 has a radius side. The Male Alignment Guide 4 can allow the lie adaptor to be inserted into putter head at two different angles, thereby allowing a user of the invention to select which angle would be appropriate for a particular golfer. The Male Alignment Guide 4 has a threaded hole 5 into which a bolt can be screwed to attach the lie adaptor to a putter head. A Connection face flat portion 8 secures the lie adaptor and prevents it from rotating within the cavity in the putter head. A second shelf 7 sits upon a corresponding shelf within the cavity of the putter head to maintain the amount that the lie adaptor is inserted into the cavity in the putter head. A first shelf 6 in between the adaptor hosel 2 and the canted joint 3 abuts the top of the cavity in the putter head, thereby providing additional control over the depth at what the lie adaptor 1 is inserted into the cavity in the putter head.

Figure 2:
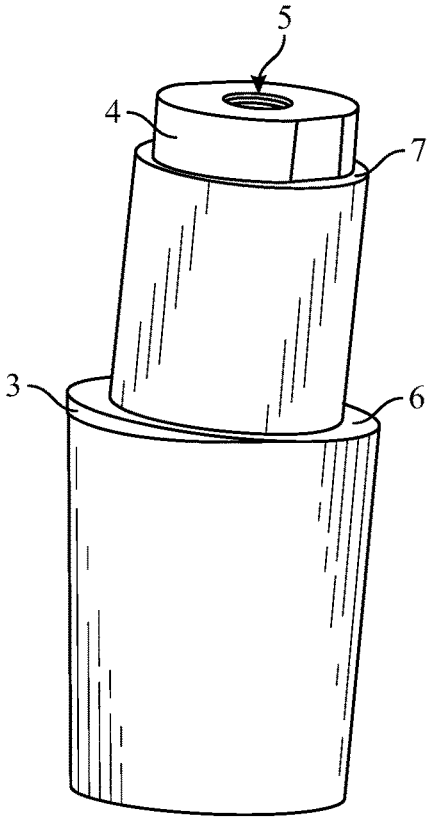
FIG. 2 is a bottom, perspective view of the embodiment illustrated in FIG.

FIG. 2 is a bottom, perspective view of the embodiment illustrated in FIG. 1. The FIG. 2 provides a more detailed view of the bottom portion of the lie adaptor 1. The male alignment guide 4 is inserted to a cavity at the top of the putter head. The second shelf 7 sits upon a corresponding shelf in the cavity of the putter head. The connection face flat portion 8 secures the lie adaptor and prevents it from rotating within the cavity in the putter head. The threaded hole 5 is a hole into which a bolt can be inserted to attach the lie adaptor to the putter head.

Figure 3:
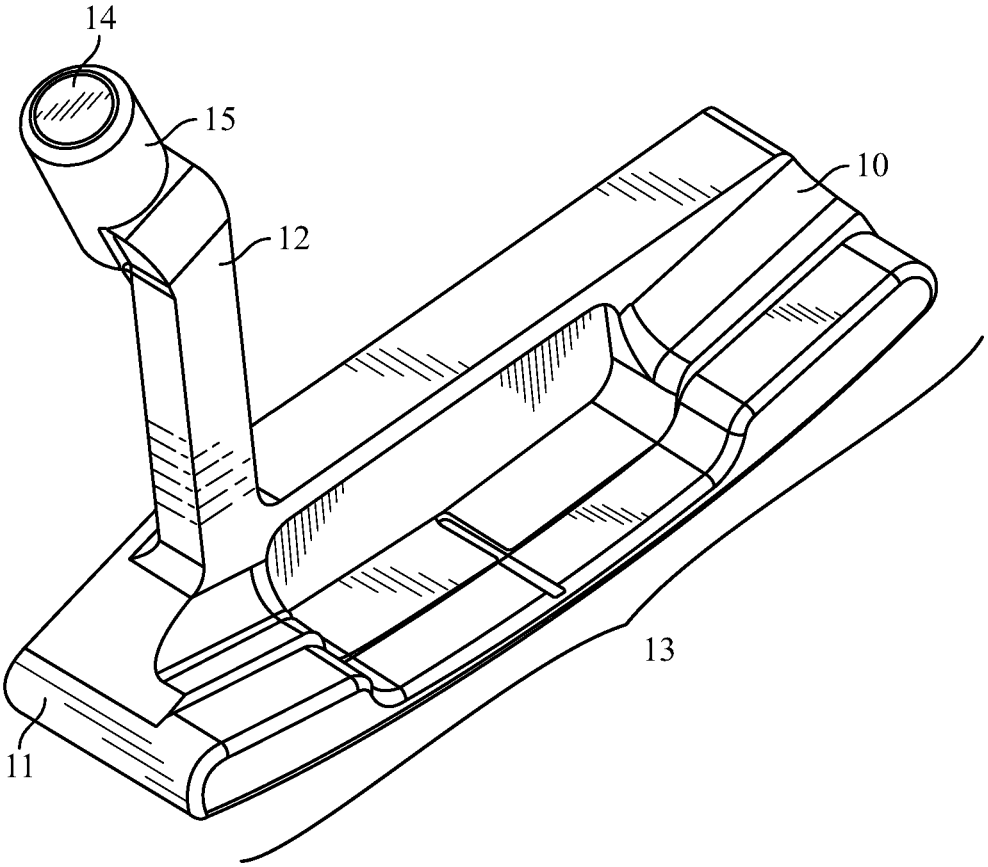
FIG. 3 is top, perspective view of a head of a putter, showing how the lie adaptor fits into a hosel outer the head of the putter.

FIG. 3 is top, perspective view of the head of a putter, showing how the lie adaptor 1 fits into the putter head. The putter head has a heel 11 and a Toe 10 of the putter. As mentioned previously, keeping the toe 10 and heel 11 even is important to keeping the ball going as targeted. Practically, when the toe or heel of the putter is raised or lowered, even slightly, above or below each other, the golf ball is automatically deflected a tiny amount. But, over the course of the putt, a "tiny amount" of deflection can easily result in a properly aimed ball missing the hole. The heel 11 of the putter connects the portion of the putter head that actually strikes the ball to the shaft by way of a neck 12. In most putter heads, the Heel 11 has a hosel inner 14 surrounded by Hosel outer 15, where the hosel inner 14 is offset at an angle different from that of the Heel 11. This is called the "lie" of the putter, and allows the golfer to strike the ball with the putter head in front of him or her, allowing for better control. However, the angle that the putter is offset from the Heel is not idea for all golfers; hence the need for this invention so that the lie of a putter can be adjusted.

Figure 4:
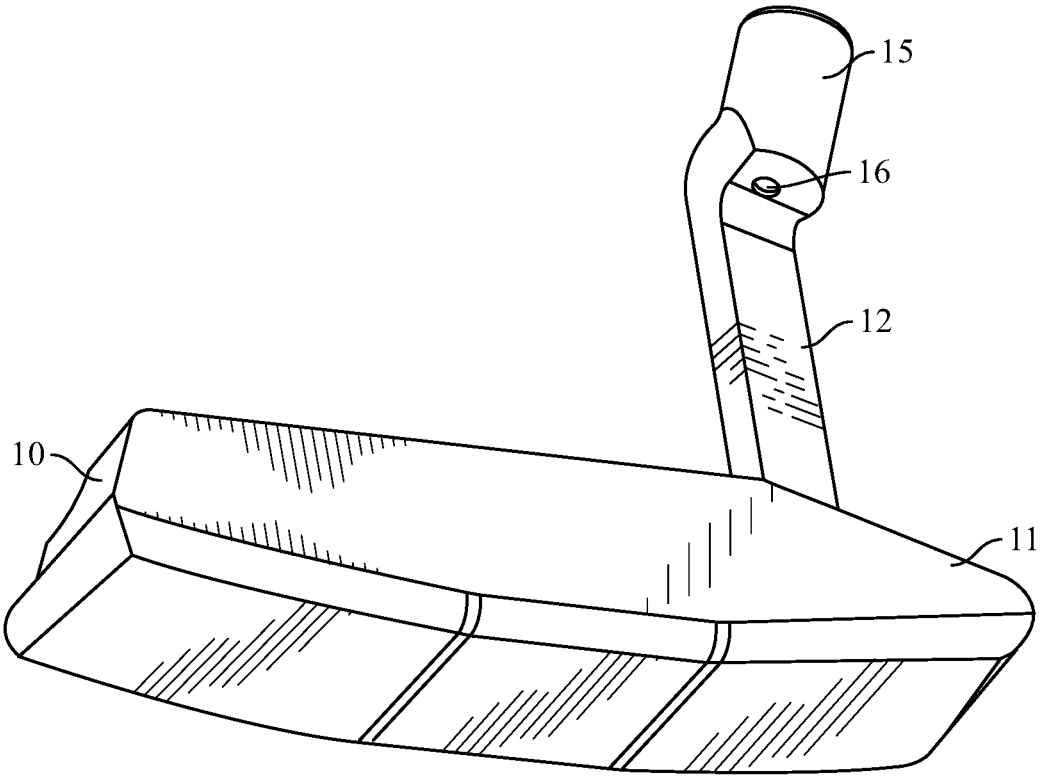
FIG. 4 is a bottom perspective of the head of the putter illustrated in FIG. 3, showing how a bolt can be used to attach the invention inside the hosel cavity of a putter head.

FIG. 4 is a bottom perspective of the head of the putter illustrated in FIG. 3, showing how a bolt can be used to attach the invention inside the hosel cavity of a putter head. The lie adaptor 1 is inserted into the hosel inner 14. The connection plate flat portion 8 prevents the lie adaptor 1 from rotating in the hosel cavity. A bolt goes through the clearance hole for bolt 16, and screws into the threads on the Threaded hole 5, thereby securing the lie adaptor to the putter head. The connection plate flat portion 8 serves three different purposes, such as keeps part from twisting when being bolted in and during use, sets the orientation of the lie angle and provides a method of receiving a Set screw 21 as illustrated in FIG. 7).

Figure 5:
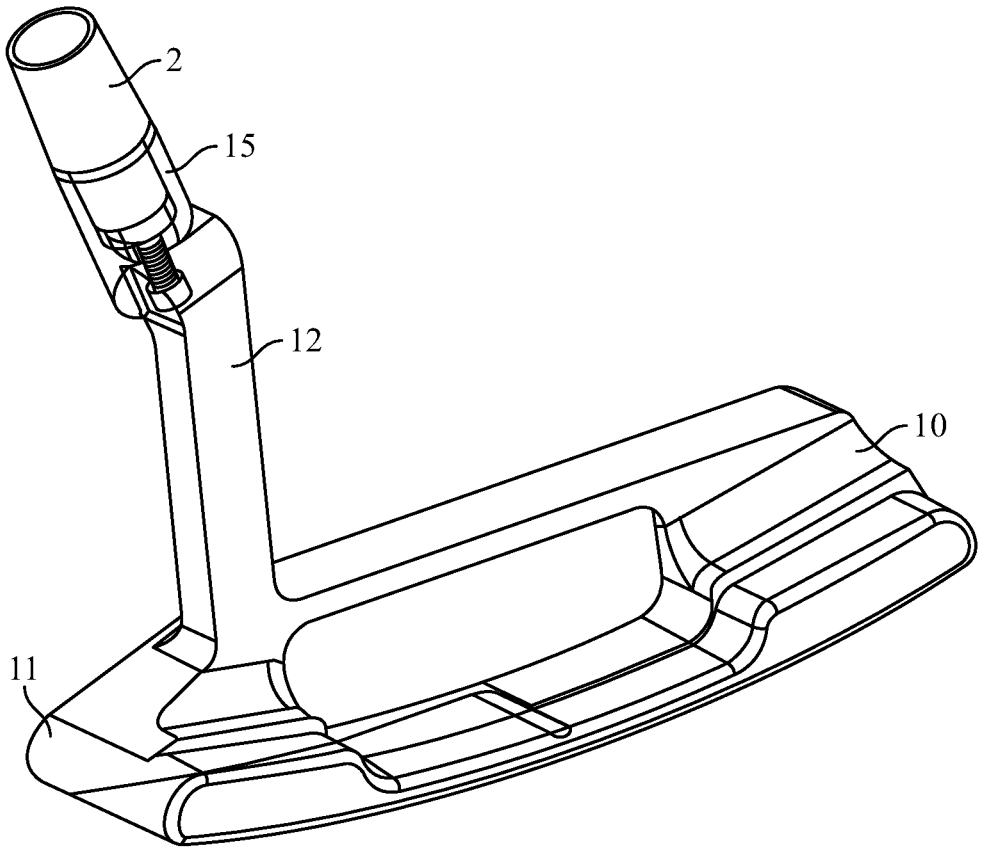
FIG. 5 is a cut-away view of the embodiment illustrated in FIGS. 1 and 2 inserted into the hosel cavity of a putter head.

FIG. 5 is a cut-away view of the embodiment illustrated in FIGS. 1 and 2 inserted into the hosel inner 14 of a putter head. In this figure, the bolt has been screwed into the clearance hole for bolt, thereby pulling the lie adaptor 1 into the hosel inner 14. The lie adaptor 1 is retained within the hosel inner 14 by the hosel outer 15. Because the canted joint 3 is offset from the angle of the hosel inner 14, the lie of the putter can be easily adjusted.

Figure 6:
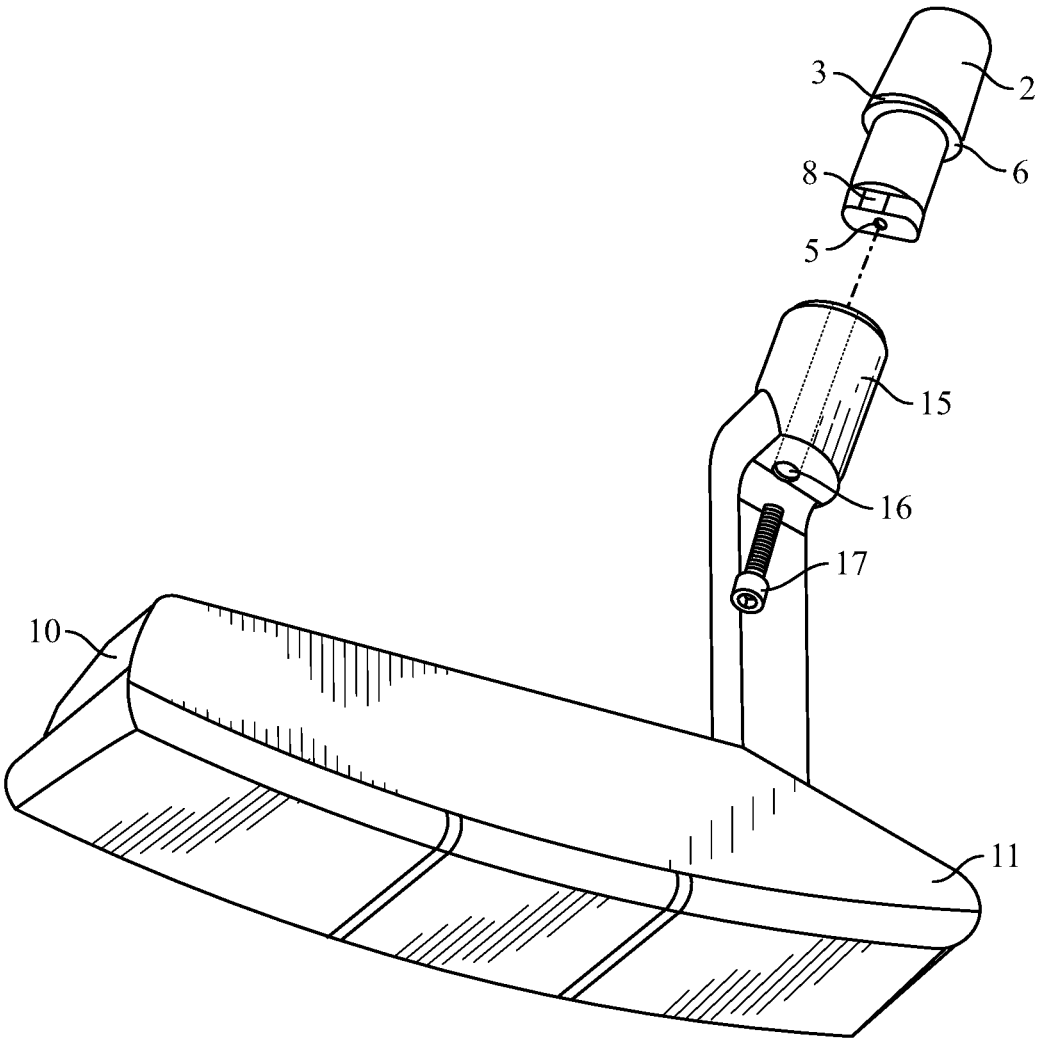
FIG. 6 is a bottom, perspective view of a second embodiment of the invention, where there is a cavity into which the shaft—particularly a solid shaft—can be inserted.

FIG. 6 is a bottom, perspective view of another embodiment of the invention, where there is a cavity into which the shaft—particularly a solid shaft—can be inserted. In this embodiment, the canted joint 3 and Male Alignment Guide 4 are identical to those in the previous embodiment, but the adaptor hosel 2, has a lie adaptor cavity 18, into which the shaft can be inserted. This allows the invention to be used with solid shafts and even with hollow shafts of different diameters without limiting the scope of the present invention.

Figure 7:
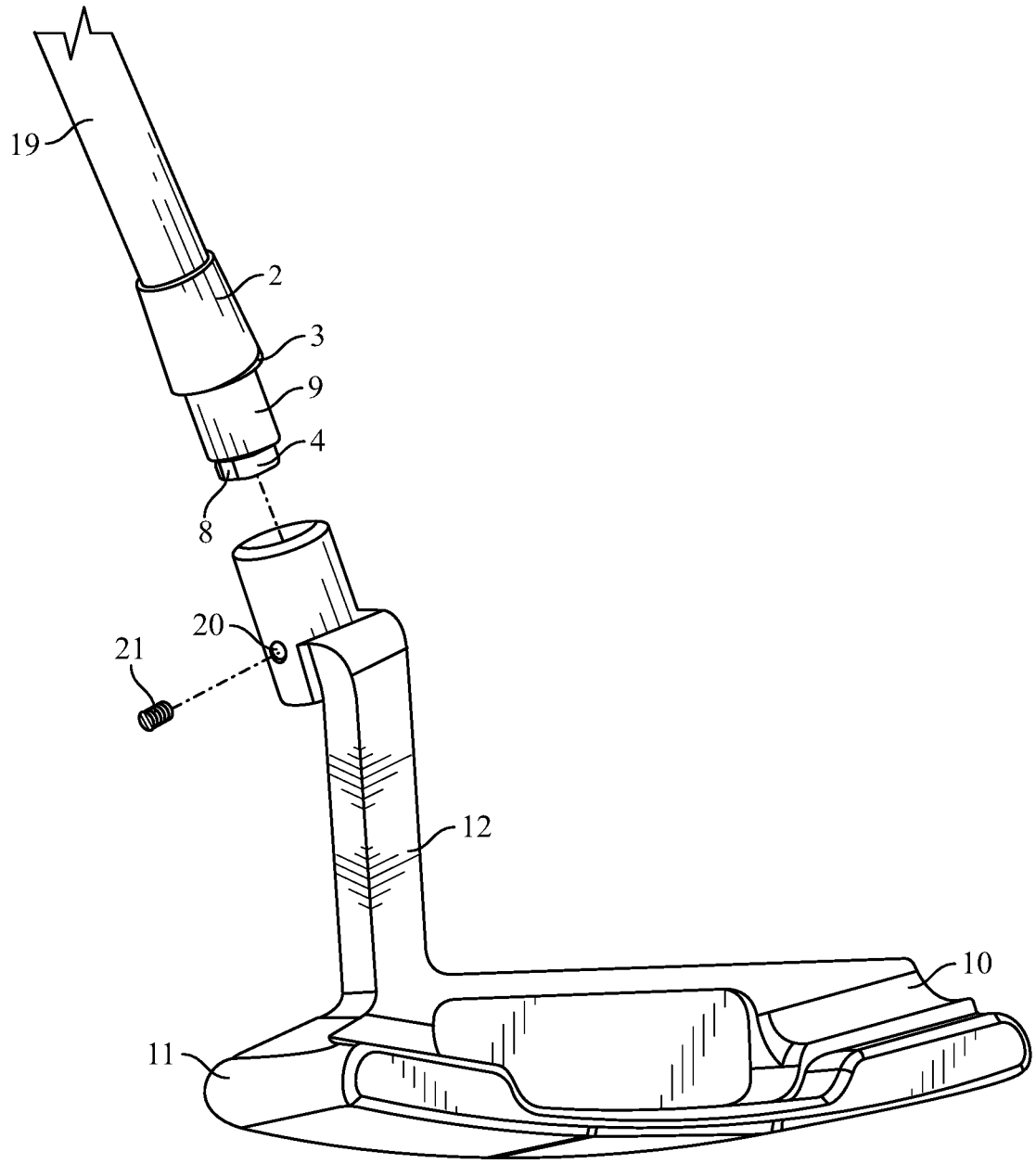
FIG. 7 is a side, perspective view of a shaft with a lie adaptor ready to be inserted into a hosel inner.

FIG. 7 is a side, perspective view of a shaft with the lie adaptor 1 in an alternative embodiment, ready to be inserted into the hosel inner 14. A putter shaft 19 has been inserted into the adaptor hosel 2. The canted joint 3 has offset the angle of connection between the putter shaft 19 and the putter. The canted shaft 9 is ready to be slid into the hosel of the putter. A male alignment guide 4 will position the lie adaptor at the proper direction inside the putter hosel. A set screw 21 will be screwed into the threaded hole 20, and will push against the connection face flat portion 8 of the lie adaptor, thereby preventing the lie adaptor from rotating within the putter hosel. The where the connection face flat portion 8 is parallel to the set screw hole 20 to optimize surface area friction on connection face flat portion 8, where the set screw 21 holds lie adaptor 1 into putter head hosel inner 14.

In this embodiment, the canted joint 3 is configured to form the offset angle of connection between the putter shaft and the putter, where the canted joint 3 is outside of the hosel outer 15 and where the putter shaft is on a separate plane to the canted shaft 9. Further, the canted joint 3 is outside of the hosel outer 15 on the putter head of the putter 13, and where the first shelf 6 has a first shelf diameter, and where the first shelf diameter is slightly larger than a diameter of the hosel outer 15 located on the putter head.

Figure 8:
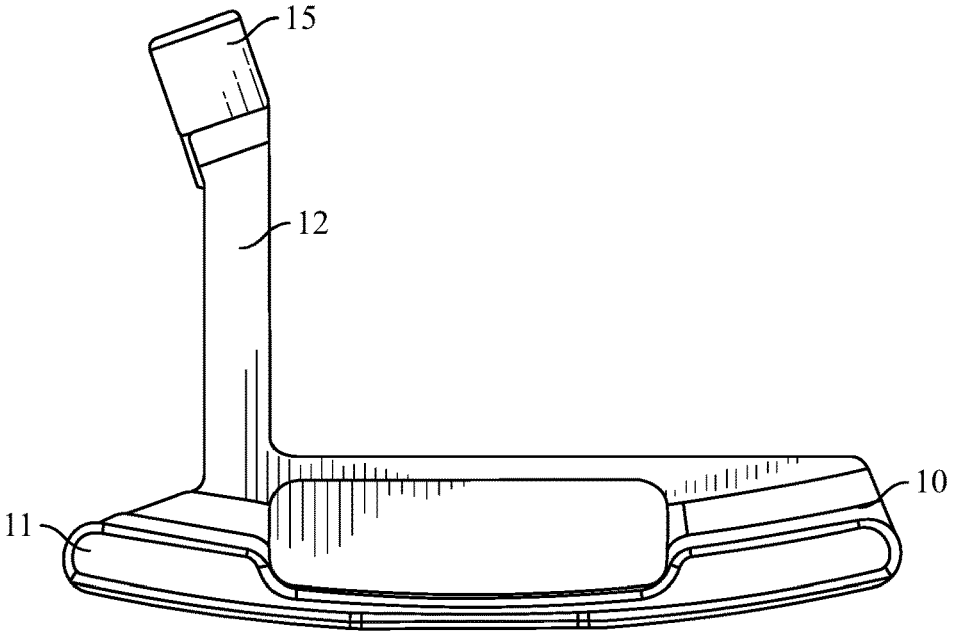
FIG. 8 is a back view of the back of a putter head.

FIG. 8 is a back view of the back of a putter head. The hosel outer 15 creates a certain angle from the neck 12. This angle will not be perfect for every golfer, hence the need for the lie adaptor.

Figure 9:
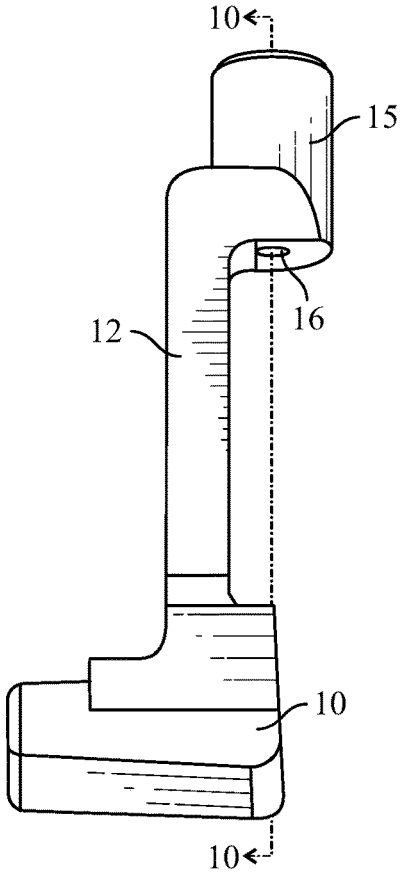
FIG. 9 is a side view of a putter head.

FIG. 9 is a side view of a putter head showing shows a clearance hole for a bolt 16 is lined up such that the lie adaptor can be bolted into place through this hole.

Figure 10:
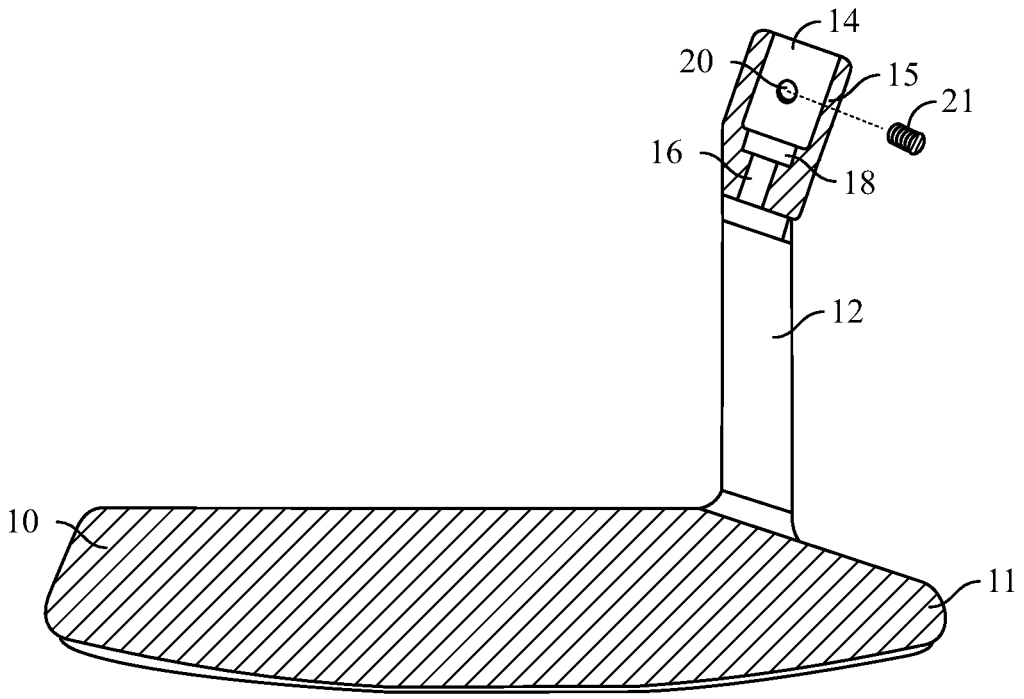
FIG. 10 is front cross-sectional view of a putter head.

FIG. 10 is front, cross-sectional view of a putter head. The clearance hole for the bolt 16 will allow a bolt to be inserted into the bottom of the lie adaptor, pull the lie adaptor down into the putter hosel, and secure it against rotation. A lie adaptor socket 18 will mate with the male alignment guide 4 (as shown in other figures) to prevent rotation of the putter around the shaft. The hosel inner 14 will hold the lie adaptor 1, secured in a set position by the hosel outer 15. Further, a set screw 21 will be screwed into the threaded hole 20, and will push against the connection face flat portion 8 of the lie adaptor, thereby preventing the lie adaptor from rotating within the hosel outer of the putter.

Figure 11:
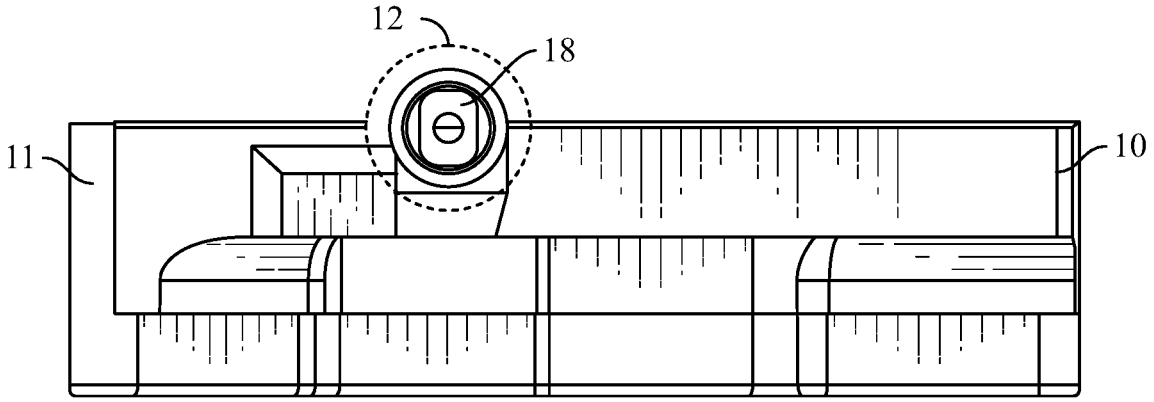
FIG. 11 is a top view of a putter head.

FIG. 11 is a top view of a putter head showing the shape of the lie adaptor socket 18, which prevents rotation of the shaft. In one embodiment, the lie adaptor socket 18 is an elliptical shape.

Figure 12:
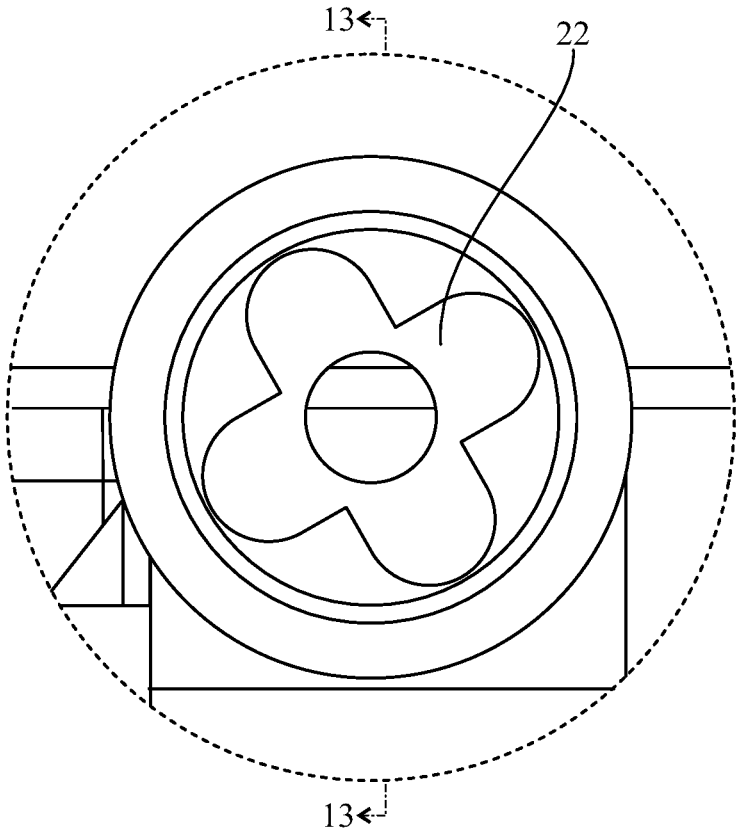
FIG. 12 is a top view of another embodiment of the invention.

FIG. 12 is a top view of another embodiment of the invention, generally referenced as 22, showing an alternate shape of the lie adaptor socket 18. The alternative version of the lie adaptor socket 18 is cross-shaped 22 rather than elliptical.

Figure 13:
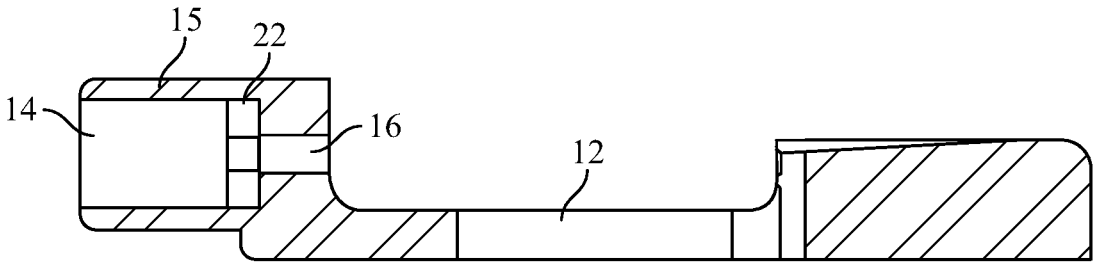
FIG. 13 is a cross-sectional view of the embodiment illustrated in FIG. 12.

FIG. 13 is a cross-sectional view of the embodiment illustrated in FIG. 12.

Figure 14:
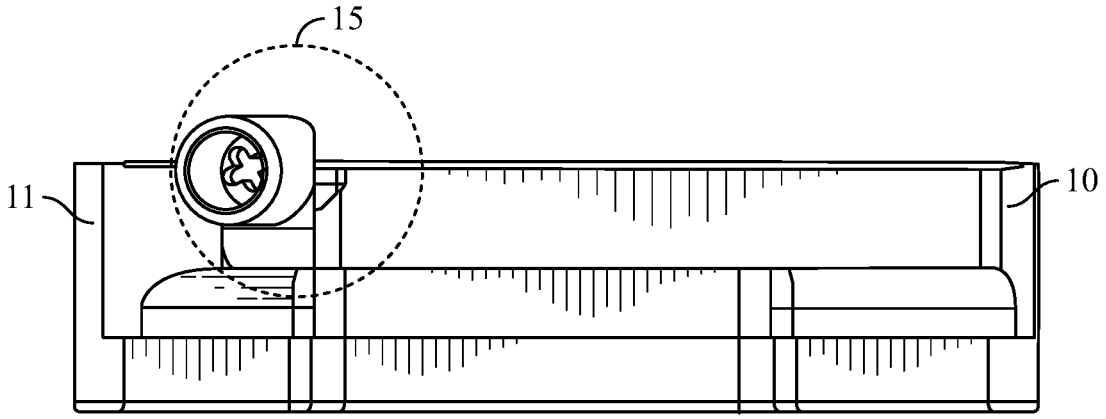
FIG. 14 is a top view of the embodiment illustrated in FIG. 12.

FIG. 14 is a top view of the embodiment illustrated in FIG. 12.

Figure 15:
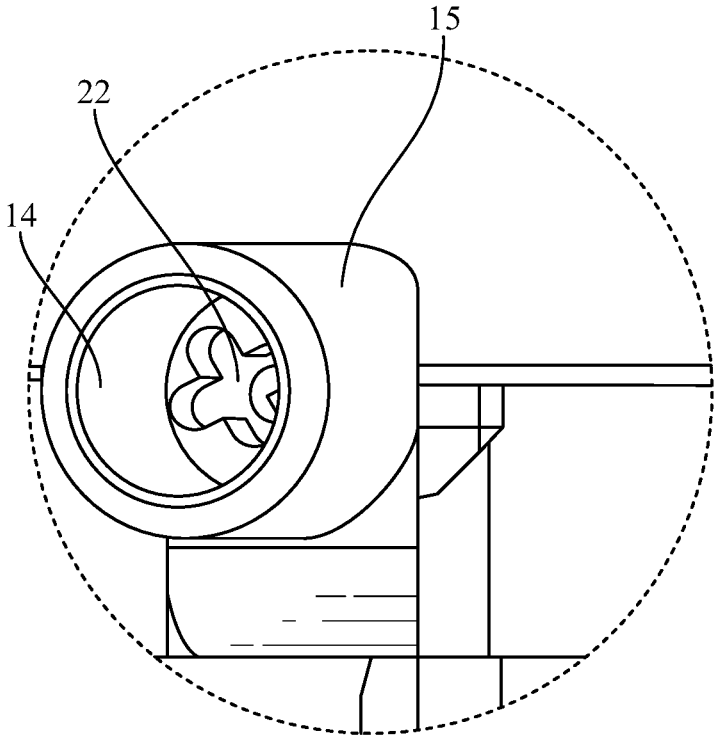
FIG. 15 is a close up view of the embodiment illustrated in FIG. 14.

FIG. 15 is a close up view of the embodiment illustrated in FIG. 14.

Figure 16:
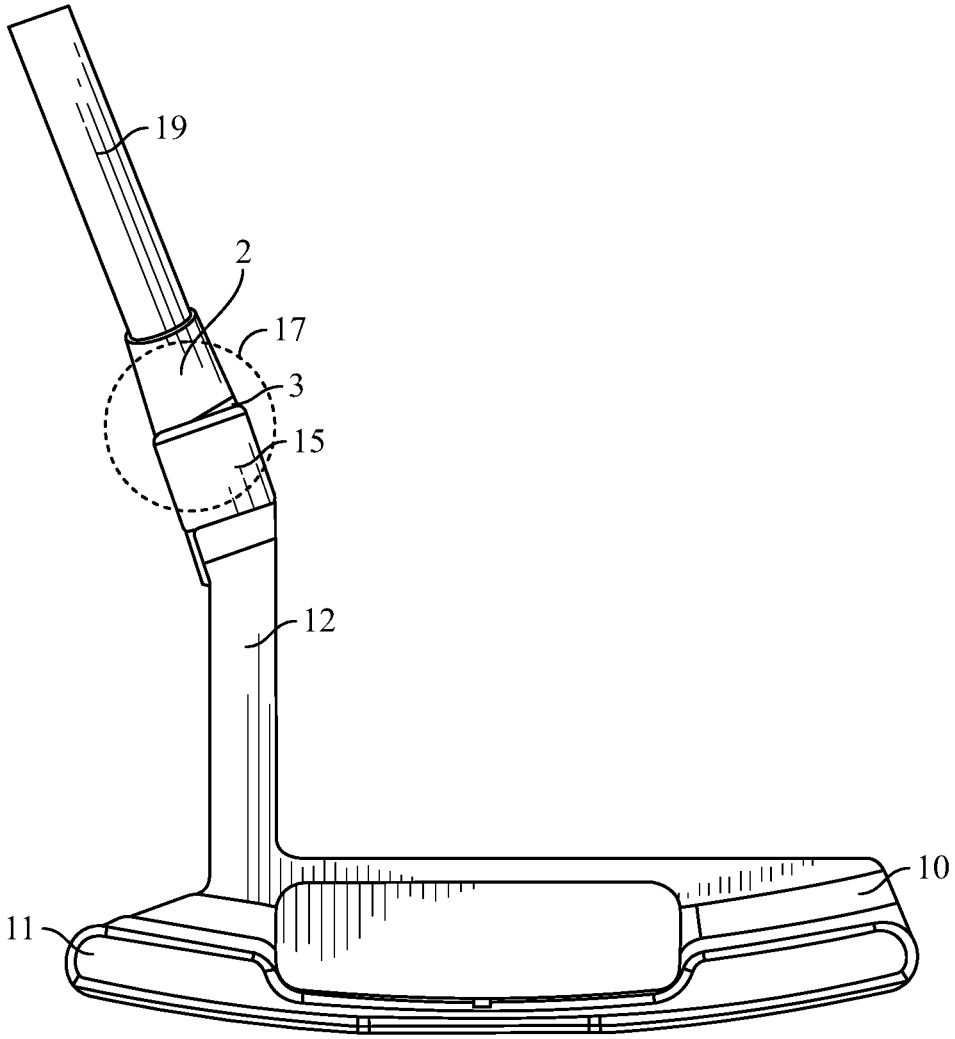
FIG. 16 is a side view of a putter with a lie adaptor in use.

FIG. 16 is a back view of a putter with a lie adaptor in use. The golf club shaft 19 has been inserted into the adaptor hosel 2. The canted shaft 9 (not seen in this figure) has been inserted into the hosel outer 15. The canted joint 3 has altered the angle between the putter shaft 19 and the putter 13.

Figure 17:
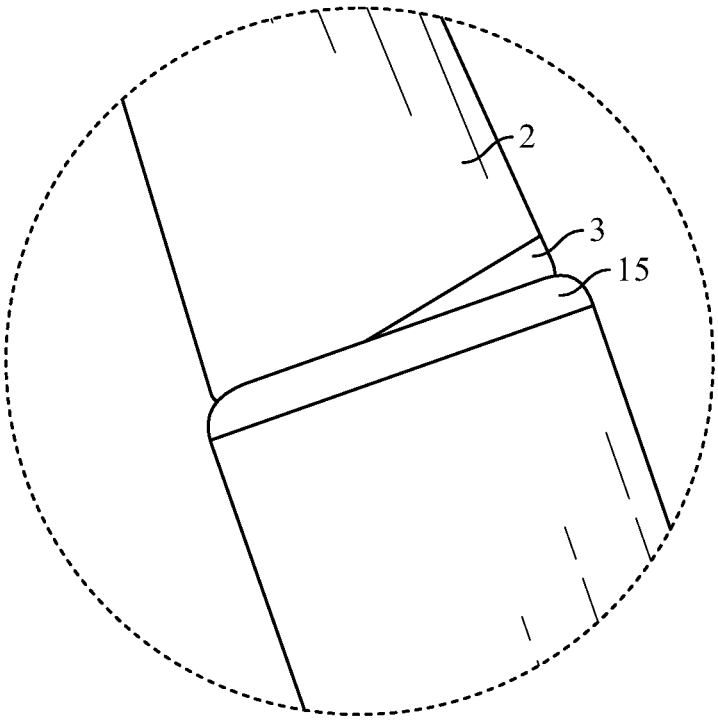
FIG. 17 is a close-up, side view of the canted joint, showing how it creates the angle for the lie adaptor.

FIG. 17 is a close-up, side view of the canted joint, showing how it creates the angle for the lie adaptor.

Figure 18:
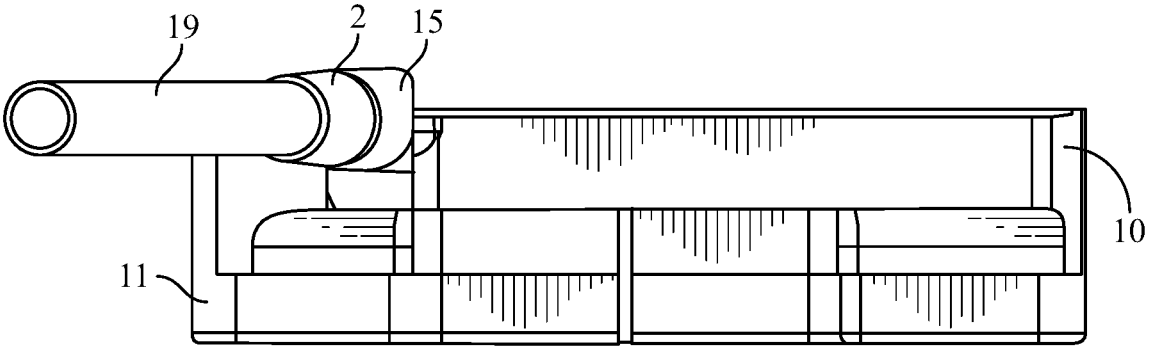
FIG. 18 is a top view of a hollow shaft fitting inside the lie adaptor.

FIG. 18 is a top view of a hollow putter shaft 19 fitting inside the lie adaptor.

Figure 19:
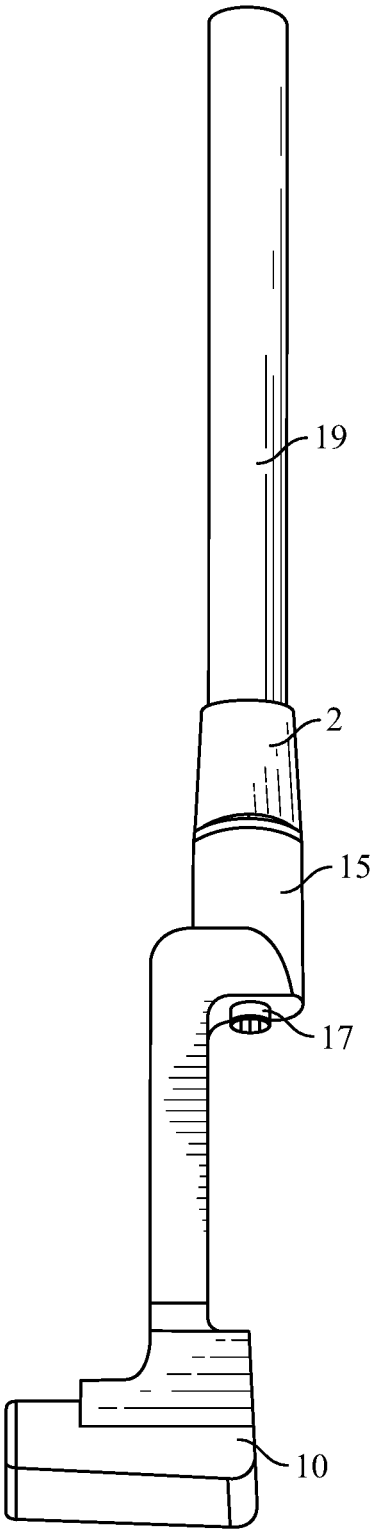
FIG. 19 is a side view of a hollow shaft fitting inside the lie adaptor.

FIG. 19 is a side view of a hollow putter shaft 19 fitting inside the lie adaptor.

Figure 20:
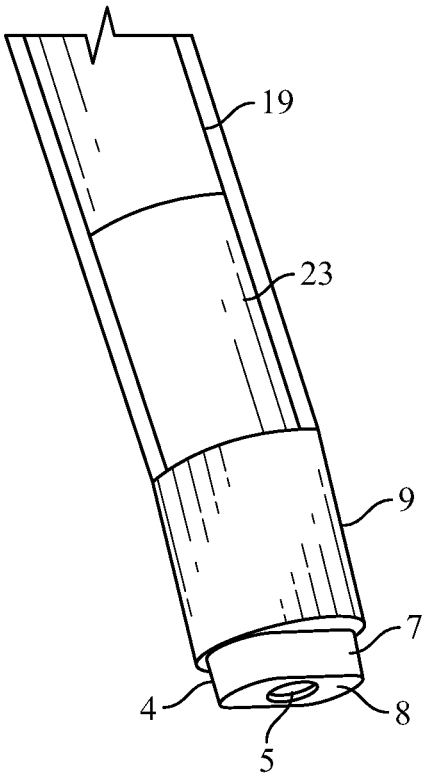
FIG. 20 is a side view of a clear, acrylic shaft going over an alternate embodiment of the invention.

FIG. 20 is a side view of a clear, acrylic shaft going over an alternate embodiment of the invention showing the hollow putter shaft 19 and alternative shape of an alternative adaptor hosel 23.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

REFERENCE NUMBERS USED

1. Lie adaptor generally—general
2. Adaptor Hosel—receives golf shaft
3. Canted joint—creates the adjustment in lie angle
4. Male Alignment Guide. Radius side allows for precious in manufacturing as the matting side should be milled—end mills rotate so must have some radius
5. Threaded hole—to receive socket head screw acts as the nut in a bolt and nut configuration
6. First Shelf—limits the depth of lie adaptor
7. Second shelf—Transition to off round portion and also limits the depth of lie adaptor when bolted together
8. Connection face flat portion—serves three purposes 1. Keeps part from twisting when being bolted in and during use 2. Sets the orientation of the lie angle. 3. Set screw receiver
9. Canted shaft—Shaft mates with hosel hole in the putter to create lie angle
10. Toe of the putter—end of putter further from the player. Used in the diagram for part orientation
11. Heal of the putter—end of putter closer to the player. Used in the diagram for part orientation
12. Neck of the putter—in some cases this neck obstructs the socket bolt, therefore, a set screw on the side is better
13. Putter generally
14. Hosel inner—hole that normally receives the shaft, but in this case receives adaptor canted shaft
15. Hosel outer—normally receives the shaft. Important for use with set screw
16. Clearance Hole for Bolt—without threads to help to allow the screw to pass through to lock with thread portion of lie adapter
17. Bolt—Socket head bolt limits depth causing the adaptor to pull tighter in bolt and nut configuration
18. Lie Adaptor Socket—This mates with lie adaptor alignment guide to restrict rotation when bolted to create a joint
19. Putter shaft
20. Threaded hole—used for set screw
21. Set Screw
22. An alternative version of 18 that is cross-shaped rather than elliptical.
23. Alternative adaptor hosel

The invention claimed is:

1. A lie adaptor, consisting of:
an adaptor hosel,
a canted joint, and
a canted shaft,
where the adaptor hosel comprises an upper end configured to receive a putter shaft of a putter, where a shaft end from the putter shaft of the putter is inserted into the adaptor hosel,
where the canted joint comprises an offset angle and a first shelf, where the canted joint is configured to form the offset angle of connection between the putter shaft and the putter, and where putter shaft is on a separate plane to the canted shaft,
where the canted shaft comprises a second shelf, a male alignment guide, a connection face flat portion, and a threaded hole, with the threaded hole has a plurality of threaded hold threads, and where the adaptor hosel and the canted shaft are on separate planes, where the canted joint connects the canted shaft to the adaptor hosel,
where the canted shaft is inserted into a cavity in an upper portion of a putter head of the putter, where the canted shaft has a canted shaft diameter, and where the canted shaft diameter is smaller than a diameter of a hosel inner on a putter head of the putter, where the canted shaft is configured to slide into the hosel inner on the putter head of the putter, and where a second shelf mates with the second shelf of the hosel inner of the putter, and where the male alignment guide mates with a lie adaptor socket in the hosel inner,
where the canted joint is outside of a hosel outer on the putter head of the putter, and where the first shelf has a first shelf diameter, and where the first shelf diameter is slightly larger than a diameter of a hosel outer located on the putter head, where canted joint connects the canted shaft in a same plane to the adaptor hosel, and where the canted joint abuts in the putter head providing additional control in a depth at what the lie adaptor is inserted in the putter head, additionally consisting of a bolt, where the bolt has a plurality of bolt threads, and where the plurality of bolt threads mate with the plurality of threaded hole threads, and where the putter has a clearance hole for bolt, with a clearance hole for bolt diameter, where the bolt has a bolt head, where the bolt head has a bolt head diameter, where the bolt head diameter is greater than the clearance hole for bolt diameter, such that the bolt can be inserted through the clearance hole for bolt, and the plurality of bolt threads can engage with the plurality of threaded hole threads, and with a rotating motion, the bolt can secure the lie adaptor into the hosel inner of the putter, where the putter has the hosel inner and the hosel outer, and a set screw threaded hole, where the set screw threaded hole extends from the hosel outer into the hosel inner, and where a set screw is screwed into the set screw threaded hole, and where the set screw contacts a connection face flat portion of the lie adaptor, where the male alignment guide allows the lie adaptor to be inserted into the putter head at two different angles, thereby allowing to select an angle that would be appropriate for a particular golfer, where the male alignment guide is elliptical, where the adaptor hosel comprises a upper end, where the canted joint comprises the offset angle and the first shelf, where the canted shaft comprises the second shelf, the male alignment guide, the connection face flat portion, and a threaded hole, with the threaded hole has a plurality of threaded hold threads, where the adaptor hosel is configured to accept the shaft end from the putter shaft, where the canted shaft has a canted shaft diameter, where the canted shaft diameter is 0.355 inch or 0.370 inch which is slightly smaller than the hosel inner diameter on the putter head, and where the second shelf mates with the hosel inner shelf, and where the male alignment guide mates with the lie adaptor socket in the hosel inner, and where the canted joint comprises the first shelf has the first shelf diameter, and where the first shelf diameter is slightly larger than the hosel outer diameter of the hosel outer located on the putter head, and additionally comprising means of connection between the male alignment guide and the lie adaptor socket.

2. The lie adaptor of claim 1, where the offset angle of the canted joint is 1 to 3 degrees and where the means of connection is epoxy.

3. The lie adaptor of claim 1, where the offset angle of the canted joint is 0.5 to 10 degrees.

4. The lie adaptor of claim 1, where the offset angle of the canted joint is 1 to 3 degrees.

5. The lie adaptor of claim 1, where the offset angle of the canted joint is 3 to 10 degrees.

* * * * *